US005751116A

United States Patent [19]

Thomas et al.

[11] Patent Number: 5,751,116

[45] Date of Patent: May 12, 1998

[54] APPARATUS TO RETROFIT AN HID LIGHT FIXTURE

[76] Inventors: Larry A. Thomas, 5481 Begonia Dr., San Jose, Calif. 95124; Kelly B. McMahon, 6690 Mt. Pakron Dr., San Jose, Calif. 95120

[21] Appl. No.: 544,000

[22] Filed: Oct. 17, 1995

[51] Int. Cl.[6] ..... H05B 41/42

[52] U.S. Cl. ..... 315/240; 315/239; 315/DIG. 4; 315/291; 323/905; 323/209; 323/908; 307/157; 307/132 E; 307/126

[58] Field of Search ..... 315/DIG. 4, 239, 315/240, 227 R, 225, 224, 171, 173, 311, 226, 291; 323/905, 908, 209; 361/2, 3, 17, 55, 56, 58, 45, 124; 307/132 E, 157, 126

[56] References Cited

U.S. PATENT DOCUMENTS 4,931,701 6/1990 Carl ..... 315/240

FOREIGN PATENT DOCUMENTS 2133232 1/1973 Germany ..... 315/DIG. 4

OTHER PUBLICATIONS

"HI/LO Lighting Systems", publication by Thomas Industries Inc, date unknown.

"Automatic Energy Reduction System", HID Lamp Control Systems for Maximum Energy Savings publication by Holophane, Mar. '1992.

*Primary Examiner*—Robert Pascal
*Assistant Examiner*—Arnold Kinkead
*Attorney, Agent, or Firm*—Flehr Hohbach Test Albritton & Herbert LLP

[57] ABSTRACT

An apparatus for retrofitting an HID light fixture is described in several embodiments. The apparatus is coupled in series with the secondary winding and the HID lamp of the HID light fixture. A first retrofit capacitor replaces the light fixture capacitor of the HID light fixture. A switching device is coupled in series with a second retrofit capacitor and couples the first and second retrofit capacitors in parallel in response to a normal power mode control input so that the HID lamp provides normal intensity lighting at normal power. The switching device uncouples the first and second retrofit capacitors from being in parallel in response to a low power mode control input so that the HID lamp provides low intensity lighting at low power. In another embodiment, a complete HID light fixture is described which comprises the ballast transformer and HID lamp described earlier and a first capacitor, a second capacitor, and switching device respectively corresponding to the first retrofit capacitor, the second retrofit capacitor, and switching device of the other embodiments.

12 Claims, 6 Drawing Sheets

APPARATUS TO RETROFIT AN HID LIGHT FIXTURE

FIELD OF THE INVENTION

The present invention relates generally to High Intensity Discharge (HID) light fixtures. In particular, it relates to an apparatus to retrofit a conventional HID light fixture which enables the HID light fixture to operate in a low power mode to save energy when normal intensity lighting is not needed and operate in a normal power mode when normal intensity lighting is needed.

BACKGROUND OF THE INVENTION

In order to properly describe the present invention, a brief description of conventional High Intensity Discharge (HID) light fixtures will be provided. In addition, their disadvantages will also be discussed prior to the discussion of the invention itself.

Referring to FIG. 1, there is shown one type of conventional High Intensity Discharge (HID) light fixture 100. The HID light fixture may be a Metal Halide, High Pressure Sodium, or other type of HID light fixture. The HID light fixture comprises, terminals 102, an alternating current (AC) light fixture capacitor 106, an HID lamp 108, and a ballast transformer all enclosed in an enclosure 110. Typically, the ballast transformer is a constant wattage autotransformer (CWA) and comprises a primary winding 112 and a secondary winding 114 which are both wound around a magnetic core 116. The secondary winding, light fixture capacitor, and HID lamp are all electrically coupled in series with each other.

When HID light fixture 100 is turned on, an AC input is provided to primary winding 112 across terminals 102. In response, secondary winding 114 provides current which is limited by capacitor 106 and passes through HID lamp 108. In response, the HID lamp provides normal intensity lighting at a normal power consumption level.

Unfortunately, there is an inherent start-up delay of several minutes after HID light fixture 100 is turned on before HID lamp 108 provides normal intensity lighting. In many applications, the long start-up delay for this type of HID light fixture makes turning it on and off as needed impractical. Thus, for these applications, the HID light fixture is continuously left on so that it continuously provides normal intensity lighting at the normal power consumption level. This results in an excessive amount of wasted energy.

One approach to solving this energy waste problem has been to provide complete HID light fixtures that following the initial start-up delay have the capability of switching between low and normal power consumption levels without any other start-up delay. FIG. 2 shows such an HID light fixture 200. In this HID light fixture, a second AC light fixture capacitor 202, terminals 204, and a switching device 206 are added. The switching device and second capacitor are coupled in series with each other across capacitor 106.

In order to avoid the start-up delay described earlier in turning on the light fixture, the light fixture is left on and run in a low power mode by providing a low power mode control input to switching device 206 across terminals 204. When this occurs, the switching device electrically uncouples capacitors 106 and 202 from being in parallel so that the current to HID lamp 108 is limited by capacitor 106 to a level at which the HID lamp provides low intensity lighting at a low power consumption level.

Since HID light fixture 200 is still on in the low power mode, it then can be switched to a normal power mode without the start-up delay described earlier. Specifically, in response to a normal power mode control input to switching device 206 across input terminals 204, the switching device electrically couples capacitors 106 and 202 in parallel so that the current to HID lamp 108 is only limited by capacitors 106 and 202 to a level at which the HID lamp provides normal intensity lighting at the normal power consumption level.

Although HID light fixture 200 provides significant savings in terms of energy consumption, the cost of removing an already existing HID light fixture 100 and installing in its place an entirely new HID light fixture 200 may not be cost effective. Additionally, the type of switching device 206 used typically comprises a solid state relay with a control circuit to open and close the solid state relay in response to the low and normal power mode control inputs. These components of the switching device are expensive and complex and therefore reduce the cost effectiveness of installing this type of HID light fixture.

An approach to solving some of the cost effectiveness and energy waste problems described earlier is shown in FIG. 3. In this approach, an apparatus 300 is used to retrofit HID light fixture 100 so that it has the capability of switching between low and normal power consumption levels. The retrofit apparatus includes terminals 302, a retrofit AC capacitor 304, a switching device 306, and terminals 308 and is enclosed in an enclosure 310. During the retrofit process, terminals 302 are electrically coupled to HID light fixture 100 so that retrofit apparatus 300 is electrically coupled in series with secondary winding 114, capacitor 106, and HID lamp 108.

To operate HID light fixture 100 in a low power mode, a low power control input is provided to switching device 306 across terminals 308. In response, the switching device electrically couples capacitors 106 and 304 in series so that the current to HID lamp 108 is limited by capacitors 106 and 304 to a level at which the HID lamp provides low intensity lighting at a low power consumption level. But, to operate the HID light fixture in a normal power mode, a normal power mode control input is provided to switching device 306 across terminals 308. When this occurs, the switching device electrically shunts capacitor 304 from being in series with capacitor 106 so that the current to HID lamp 108 is only limited by capacitor 106 to a level at which the HID lamp provides normal intensity lighting at the normal power consumption level.

Although retrofit apparatus 300 provides significant savings in terms of energy consumption, it suffers from reliability problems. Specifically, it utilizes a capacitor 106 that already exists in HID light fixture 100 and the condition and remaining life expectancy of this capacitor may not be acceptable for reliable use over an extended period of time. In addition, if the type of switching device 306 used in the retrofit apparatus uses an electromechanical relay, it may also be unreliable since welding of the contacts of the relay can occur due to the charge stored by capacitor 304 when it is shunted during the normal power mode.

Furthermore, retrofit apparatus 300 also has rather significant installation costs. A fiber optic line is typically used to provide the power mode control inputs to the retrofit apparatus so that it requires an internal power supply and amplifier for converting the power mode control inputs to electrical signals. This also has the disadvantage of making the retrofit apparatus less cost effective. Moreover, if the retrofit apparatus uses a solid state relay, as in the HID light fixture 200 of FIG. 2, then the retrofit apparatus may not be cost effective.

SUMMARY OF THE INVENTION

In one embodiment, the foregoing problems are solved by a novel apparatus for retrofitting an HID light fixture. The HID light fixture comprises prior to retrofitting a ballast transformer with a primary winding and a secondary winding, an HID lamp, and a light fixture capacitor coupled in series with the secondary winding and the HID lamp. The light fixture capacitor is uncoupled from the secondary winding and the HID lamp during retrofitting.

The retrofit apparatus comprises a pair of terminals, a first retrofit capacitor, a second retrofit capacitor, and a switching device. The terminals are used to couple the apparatus in series with the secondary winding and the HID lamp so as to replace the light fixture capacitor. The first retrofit capacitor is coupled between the terminals. The switching device is coupled in series with the second retrofit capacitor between the terminals and couples the first and second retrofit capacitors in parallel in response to a normal power mode control input. It uncouples the first and second retrofit capacitors from being in parallel in response to a low power mode control input.

The HID lamp provides normal intensity lighting at normal power in response to an AC input to the primary winding and the normal power mode control input to the switching device. It provides low intensity lighting at low power in response to an AC input to the primary winding and the low power mode control input to the switching device.

In another embodiment, the retrofit apparatus comprises the terminals, the second retrofit capacitor, and the switching device described above. But, in this embodiment, the light fixture capacitor is actually replaced in the HID light fixture by the first retrofit capacitor during retrofitting of the HID light fixture. The terminals are used to couple the apparatus in parallel with the first retrofit capacitor and in series with the secondary winding and the HID lamp. Otherwise, the operation and configuration of the retrofitted HID light fixture and the retrofit apparatus in the normal and low power modes are the same as was described earlier.

In still another embodiment, a complete HID light fixture may be provided which comprises the ballast transformer and HID lamp described earlier. In addition, it comprises a first capacitor, a second capacitor, and a switching device corresponding respectively to the first retrofit capacitor, the second retrofit capacitor, and the switching device discussed earlier. The first capacitor is coupled in series with the secondary winding and the HID lamp. The switching device is coupled in series with the second capacitor across the first capacitor.

The switching device comprises an in-rush current limiter and a relay with two sets of contacts coupled in series with the in-rush limiter. The relay simultaneously closes the two sets of contacts in response to the normal power mode control input so that the first and second capacitors are coupled in parallel and the HID lamp provides normal intensity lighting in response to an AC input to the primary winding. And, the relay simultaneously opens the two sets of contacts in response to the low power mode control input so that the first and second capacitors are not coupled in parallel and the HID lamp provides low intensity lighting in response to an AC input to the primary winding.

DETAILED DESCRIPTION OF THE INVENTION

Figure 4:
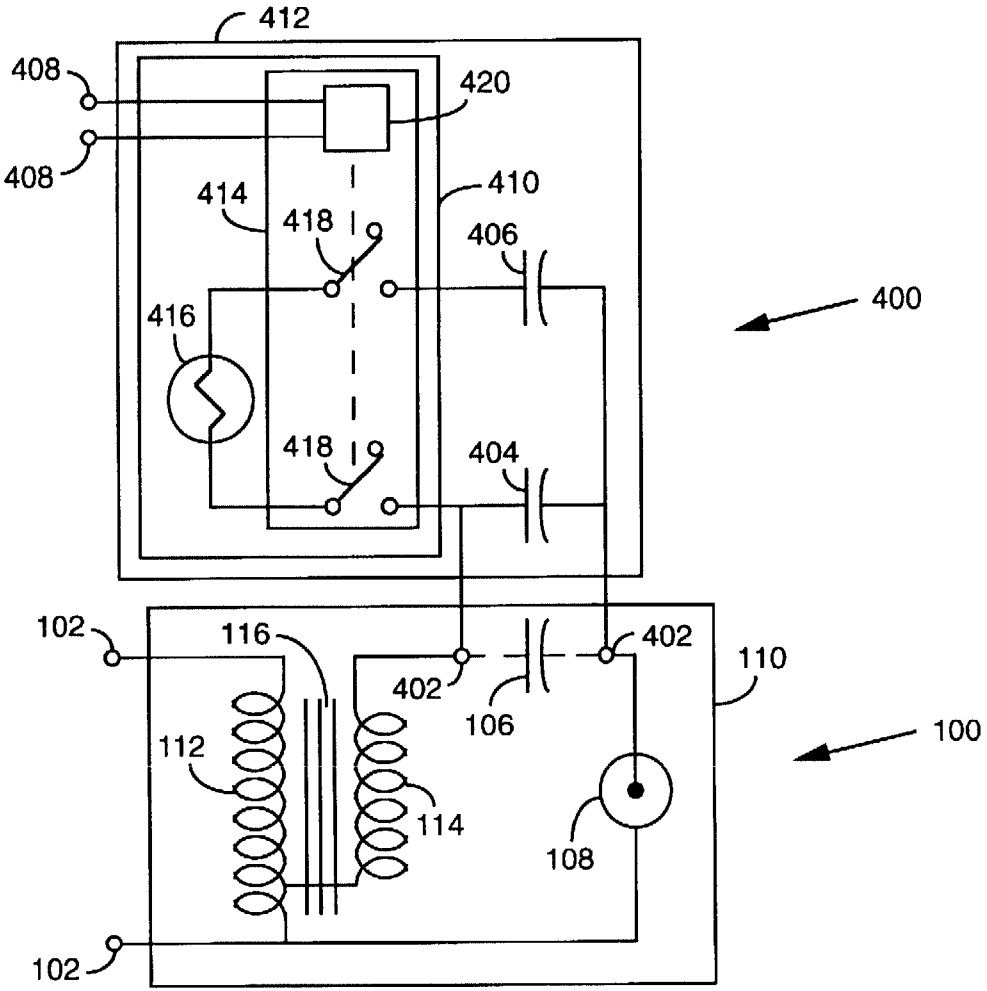
FIG. 4 shows an apparatus in accordance with the present invention for retrofitting the HID light fixture of FIG. 1.

Turning to FIG. 4, there is shown an apparatus 400 to retrofit HID light fixture 100 described earlier. As will be evident from the following discussion, the retrofit apparatus enables the HID light fixture to reliably operate in a low power mode to save energy when not in use and in a normal power mode during normal operation.

During the retrofit process, capacitor 106 is electrically uncoupled from secondary winding 114 and HID lamp 108 in HID light fixture 100. Then, terminals 402 of retrofit apparatus 400 are electrically coupled to HID light fixture 100 so that the retrofit apparatus is electrically coupled in series with the secondary winding and the HID lamp and electrically replaces capacitor 106. These terminals may comprise two electrical wire connectors to provide easy and quick installation of the retrofit apparatus on the HID light fixture.

In addition to terminals 402, retrofit apparatus 400 comprises two retrofit AC capacitors 404 and 406, terminals 408, and a switching device 410. The retrofit apparatus is enclosed by enclosure 412.

Capacitor 404 is electrically coupled between terminals 402. Furthermore, capacitor 406 and switching device 410 are electrically coupled in series with each other between terminals 402 and they are together electrically coupled in parallel to capacitor 404.

In the embodiment of FIG. 4, switching device 410 comprises an inrush current limiter 416 and an electromechanical relay 414. The relay has two sets of contacts 418 and a coil based relay control mechanism 420. The two sets of contacts and the in-rush current limiter 402 are electrically coupled in series and may be done so in any order. The relay control mechanism electromechanically opens and closes the two sets of contacts simultaneously. In an alternative embodiment, a solid state relay coupled in series with the inrush current limiter may be used instead of electromechanical relay 414.

In a normal power mode, a normal power mode control signal is provided to relay control mechanism 420 across terminals 408 by an external control system (not shown). In response, contacts 418 are simultaneously closed by the relay control mechanism so that capacitors 404 and 406 are electrically coupled in parallel. The combined parallel capacitance of these capacitors is selected to be approximately equal to the capacitance of capacitor 106. Thus, when an AC input is provided to primary winding 112 across terminals 102, the current provided by secondary winding 114 to HID lamp 108 is limited by the parallelly coupled capacitors to approximately the same extent as that by capacitor 106 prior to the retrofit. As a result, the HID lamp provides normal intensity lighting at a normal power consumption level.

However, in a low power mode, the control system provides a low power mode control input to relay control mechanism 420 across terminals 408. In response, contacts 418 are simultaneously opened by the relay control mechanism so that capacitors 404 and 406 are not electrically coupled in parallel. In this case, when an AC input is provided to primary winding 112 across terminals 102, the current provided by secondary winding 114 to HID lamp 108 is sufficiently limited by capacitor 404 so that the HID lamp provides low intensity lighting at a low power consumption level. The capacitance of capacitor 404 is selected so as to limit the current to the HID lamp to this extent.

As is clear from the foregoing, when normal intensity lighting is not needed, retrofitted HID light fixture 100 can operate in a low power mode while enabling instantaneous switching to a normal power mode when normal intensity lighting is needed. Thus, by operating in a low power mode, energy is saved and long start-up delays are avoided. Furthermore, as those skilled in the art will recognize, additional capacitors and switching devices may be used in a similar manner to that just described to provide additional low power modes with lighting intensities at corresponding levels of power consumption.

Moreover, as indicated earlier, capacitor 106 is electrically uncoupled from the circuitry of HID light fixture 100 during the retrofit process. This is done because the capacitor's condition and remaining life expectancy at the time of the retrofit may not be acceptable for reliable use over an extended period of time. Thus, by instead using retrofit capacitors 404 and 406 whose condition and life expectancy are known, the reliable operation of the retrofitted HID light fixture 100 is ensured over the long term.

Additionally, the construction of switching device 410 in the embodiment of FIG. 4 provides reliable and efficient switching between the low and normal power modes. The need for a reliable switching device stems from the fact that capacitor 404 may be charged at voltages exceeding 300 volts during the low power mode. When switching to the normal power mode, the charged stored in this capacitor is also switched. Since capacitor 406 is not charged at this point, the use of in-rush current limiter 416 and the double contact configuration provided by relay 414 ensures that welding and/or arcing of relay contacts 418 does not occur. The in-rush current limiter may comprise a negative temperature coefficient (NTC) thermistor designed to have a resistance of near zero during the normal power mode.

Moreover, the construction of switching device 410 in the embodiment of FIG. 4 also makes the installation of retrofit apparatus 400 cost effective. This is because the electromechanical relay 414 and in-rush current limiter 416 are discrete off the shelf electrical components that are commercially available and inexpensive.

However, in alternative embodiments, the relay could instead be a solid state relay with a control circuit, as described earlier for the HID light fixture 200. And, switching device 410 may or may not comprise an in-rush current limiter. If an in-rush current limiter is used, it would reliably ensure that the solid state relay is not burned out.

In other alternative embodiments, relay 414 may have a single contact configuration with only one set of contacts and switching device 410 may or may not comprise an in-rush current limiter. The switching device in any of these embodiments would not ensure against welding of the contacts as reliably as in the embodiment of FIG. 4 discussed earlier.

For fail safe operation, relay 414 of the embodiment of FIG. 4 has a double break contact configuration with both sets of contacts 418 normally closed in response to a low voltage input to relay control mechanism 420 across terminals 408. In this configuration, the normal and low power mode control inputs respectively comprise a low and a high voltage input so that HID light fixture 100 will operate in the normal power mode and provide normal intensity lighting even if switching device 410 becomes defective or the control system providing the low and normal power mode control inputs becomes defective. Alternatively, relay 414 could have a double make contact configuration with both sets of contacts normally open in response to a low voltage input. In this configuration, the normal and low power mode control inputs would respectively comprise a high and a low voltage input but fail safe operation would not be provided like in the double break contact configuration.

Figure 1:
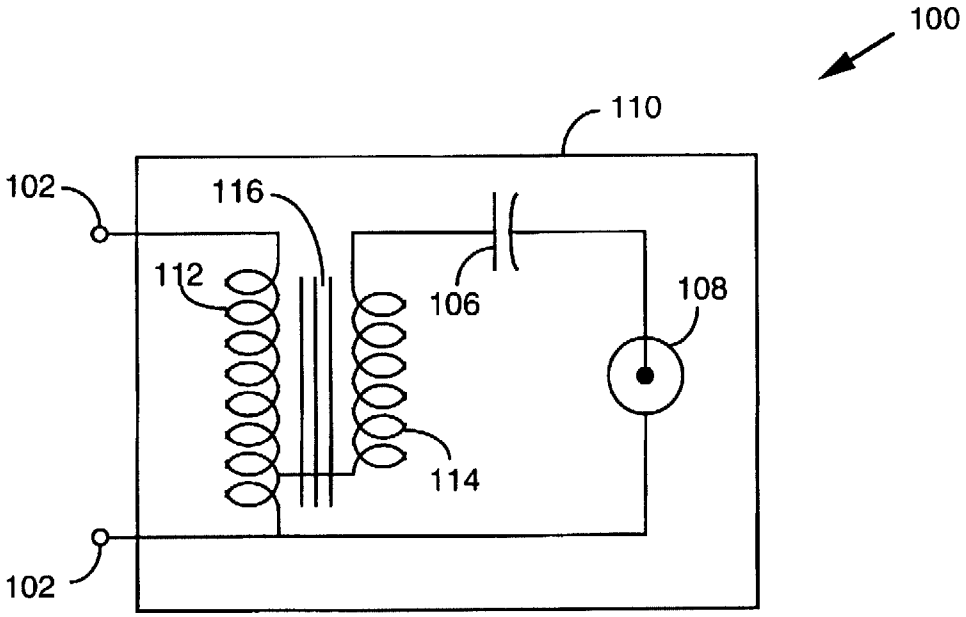
Figure 1 (Prior Art)
FIG. 1 shows a conventional HID light fixture.
Figure 2:
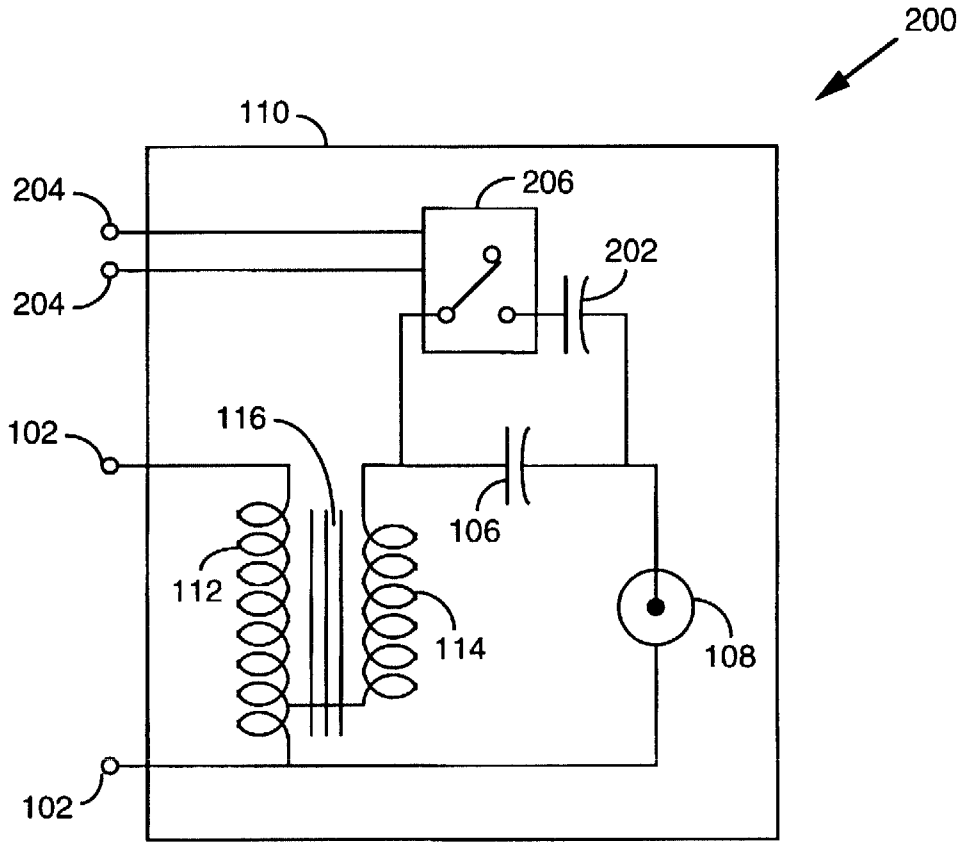
Figure 2 (Prior Art)
FIG. 2 shows another conventional HID light fixture.
Figure 3:
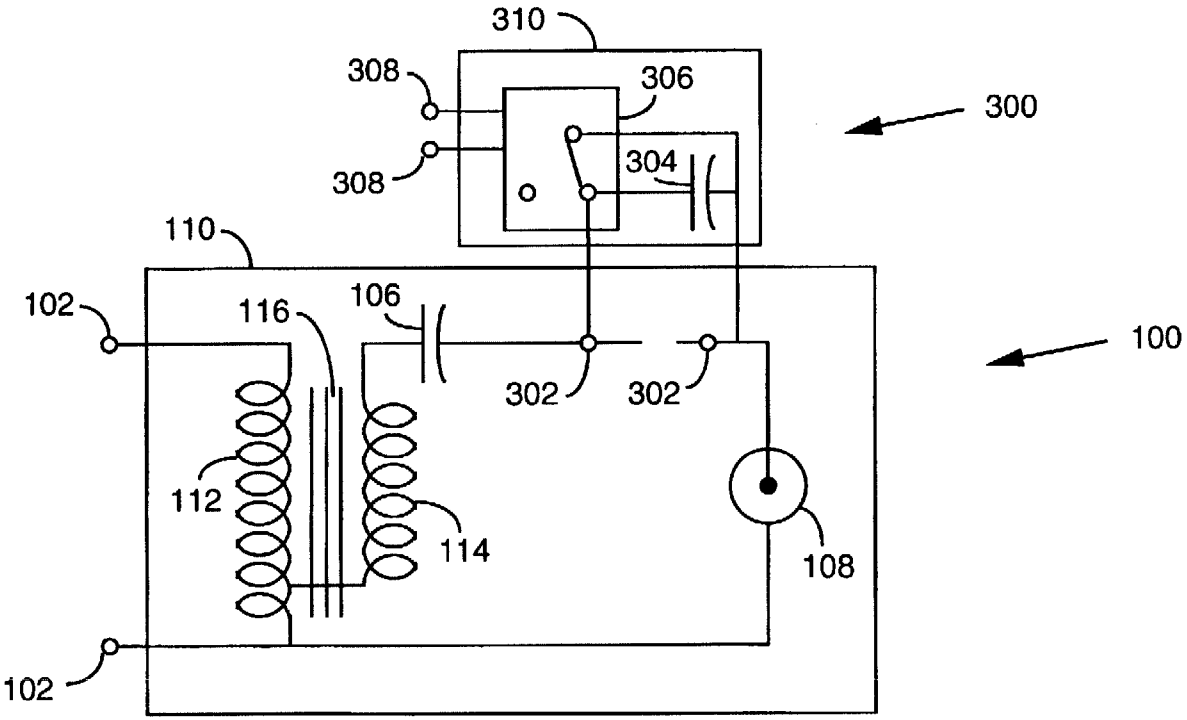
Figure 3 (Prior Art)
FIG. 3 shows a conventional apparatus for retrofitting the HID light fixture of FIG. 1.
Figure 5:
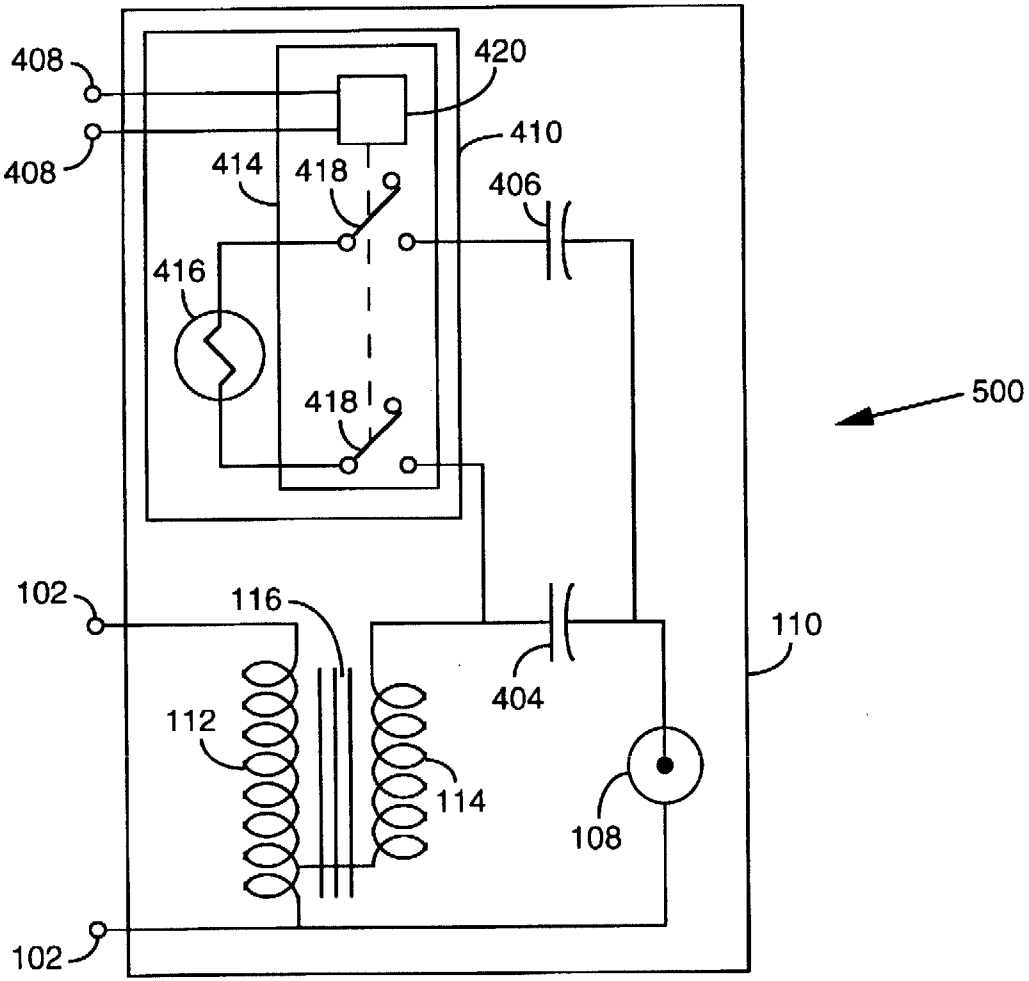
FIG. 5 shows an HID light fixture in accordance with the present invention.

In an alternative embodiment shown in FIG. 5, switching device 410 could also be used to replace switching device 206 of HID light fixture 200 shown in FIG. 2 and described earlier. In this case, a complete HID light fixture 500 with the low and normal power modes described earlier would be provided.

Figure 6:
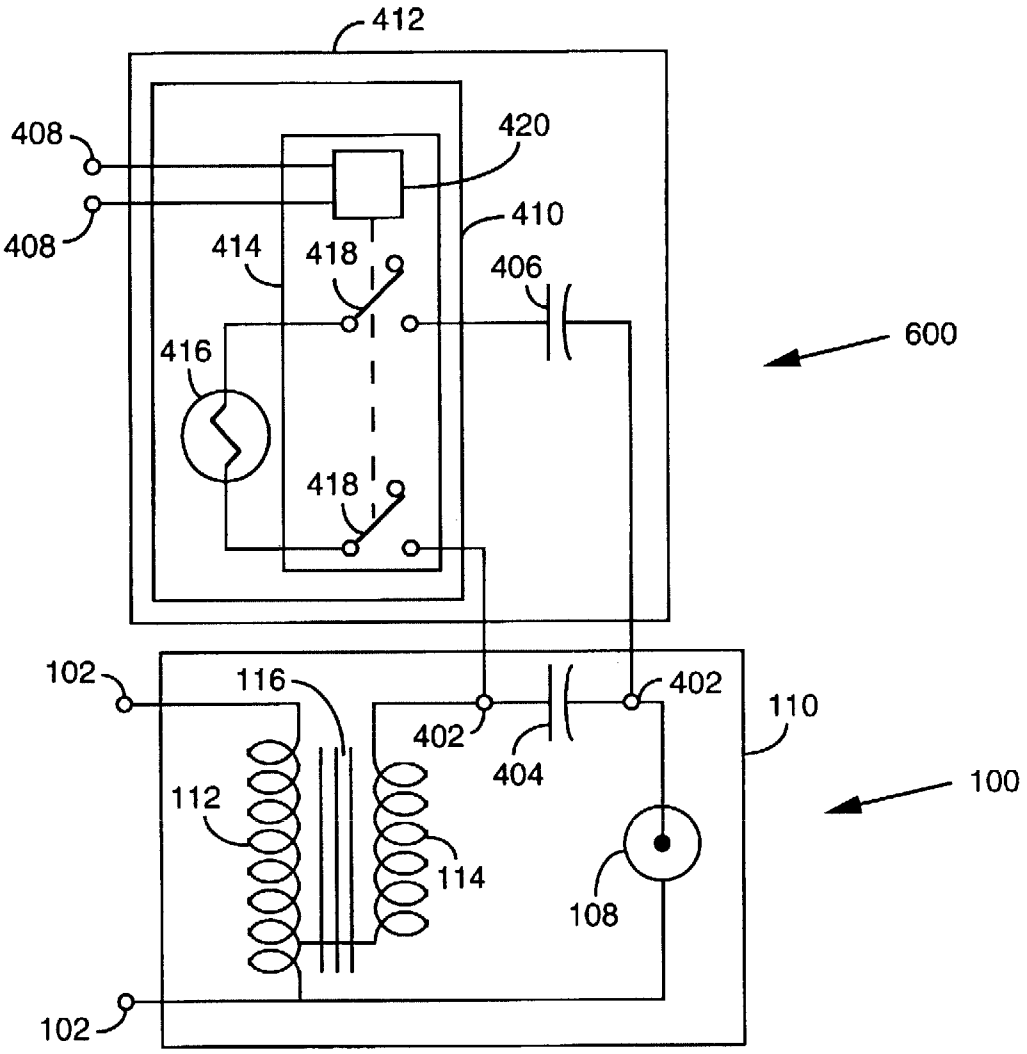
FIG. 6 shows another apparatus in accordance with the present invention for retrofitting the HID light fixture of FIG. 1.

Referring to FIG. 6, in another alternative embodiment, capacitor 106 is replaced by capacitor 404 in HID light fixture 100 during the retrofit process. In this case, the retrofit apparatus 600 would be electrically coupled in parallel to capacitor 404 and in series with secondary winding 114 and HID lamp 108. The operation of the retrofitted HID light fixture in the low and normal power modes would be the same as described earlier.

While the present invention has been described with reference to a few specific embodiments, the description is illustrative of the invention and is not to be construed as limiting the invention. Furthermore, various other modifications may occur to those skilled in the art without departing from the true spirit and scope of the invention as defined by the appended claims.

What is claimed is:

1. An apparatus without a ballast transformer for retrofitting an HID light fixture, the HID light fixture comprising prior to retrofitting a ballast transformer with a primary winding and a secondary winding, an HID lamp, and a light fixture capacitor coupled in series with the secondary winding and the HID lamp, the light fixture capacitor being uncoupled from the secondary winding and the HID lamp during retrofitting, the apparatus comprising:

a pair of terminals;

a first retrofit capacitor coupled between the terminals;

a second retrofit capacitor;

a switching device coupled in series with the second retrofit capacitor between the terminals to (a) couple the first and second retrofit capacitors in parallel in response to a normal power mode control input, and (b) uncouple the first and second retrofit capacitors from being in parallel in response to a low power mode control input; and;

an enclosure that encloses the first and second retrofit capacitors and the switching device but does not enclose the terminals and any ballast transformer:

wherein, when the apparatus is coupled with the terminals in series with the secondary winding and the HID lamp so that the light fixture capacitor is replaced by the apparatus, the HID lamp provides normal intensity lighting at normal power in response to an AC input to the primary winding and the normal power mode control input to the switching device and provides low intensity lighting at low power in response to an AC input to the primary winding and the low power mode control input to the switching device.

2. An apparatus as in claim 1 wherein the switching device comprises:

an in-rush current limiter;

a relay with two sets of contacts coupled in series with the in-rush current limiter, the relay simultaneously closing the two sets of contacts in response to the normal power mode control input and simultaneously opening the two sets of contacts in response to the low power mode control input.

3. An apparatus as in claim 2 wherein the in-rush current limiter is a negative temperature coefficient thermistor.

4. An apparatus as in claim 2 wherein:

the relay is a double break relay such that the two sets of contacts are normally closed when the relay receives a low voltage input;

the normal power mode control input comprises a low voltage input; and the low power mode control input comprises a high voltage input.

5. An apparatus without a ballast transformer for retrofitting an HID light fixture, the HID light fixture comprising prior to retrofitting a ballast transformer with a primary winding and a secondary winding, an HID lamp, and a light fixture capacitor coupled in series with the secondary winding and the HID lamp, the light fixture capacitor being replaced by a first retrofit capacitor during retrofitting, the apparatus comprising:

a pair of terminals;

a second retrofit capacitor;

a switching device coupled in series with the second retrofit capacitor between the terminals such that, when the apparatus is coupled with the terminals in parallel with the first retrofit capacitor, the switching device (a) couples the first and second retrofit capacitors in parallel in response to a normal power mode control input, and (b) uncouples the first and second retrofit capacitors from being in parallel in response to a low power mode control input; and an enclosure that encloses the second retrofit capacitor and the switching device but does not enclose the terminals, the first retrofit capacitors, and any ballast transformer;

wherein, when the apparatus is coupled with the terminals in series with the secondary winding and the HID lamp so that the light fixture capacitor is replaced by the apparatus, the HID lamp provides low intensity lighting in response to an AC input to the primary winding and the low power mode control input to the switching device and provides normal intensity lighting in response to an AC input to the primary winding and the normal power mode control input to the switching device.

6. An apparatus as in claim 5 wherein the switching device comprises:

an in-rush current limiter;

a relay with two sets of contacts coupled in series with the in-rush current limiter, the relay simultaneously closing the two sets of contacts in response to the normal power mode control input and simultaneously opening the two sets of contacts in response to the low power mode control input.

7. An apparatus as in claim 6 wherein the in-rush current limiter is a negative temperature coefficient thermistor.

8. An apparatus as in claim 6 wherein:

the relay is a double break relay such that the two sets of contacts are normally closed when the relay receives a low voltage input;

the normal power mode control input comprises a low voltage input; and the low power mode control input comprises a high voltage input.

9. A method of retrofitting an HID light fixture, the HID light fixture comprising prior to retrofitting a ballast transformer with a primary winding and a secondary winding, an HID lamp, and a light fixture capacitor coupled in series with the secondary winding and the HID lamp, the method comprising the steps of:

uncoupling the light fixture capacitor from the secondary winding and the HID lamp;

providing a retrofit apparatus that does not comprise a ballast transformer but does comprise:

a pair of terminals;

a first retrofit capacitor coupled between the terminals;

a second retrofit capacitor; and a switching device coupled in series with the second retrofit capacitor between the terminals such that, when the HID light fixture is retrofitted with the apparatus, the switching device (a) couples the first and second retrofit capacitors in parallel in response to a normal power mode control input, and (b) uncouples the first and second retrofit capacitors from being in parallel in response to a low power mode control input; and coupling a first one of the terminals to the secondary winding and a second one of the terminals to the HID lamp so that the retrofit apparatus is in series with the secondary winding and the HID lamp and replaces the light fixture capacitor;

wherein the HID lamp provides normal intensity lighting at normal power in response to an AC input to the primary winding and the normal power mode control input to the switching device and provides low intensity lighting at low power in response to an AC input to the primary winding and the low power mode control input to the switching device.

10. The method of claim 9 wherein the retrofit apparatus further comprises an enclosure that encloses the first and second retrofit capacitors and the switching device but does not enclose the terminals and any ballast transformer.

11. A method of retrofitting an HID light fixture, the HID light fixture comprising prior to retrofitting a ballast transformer with a primary winding and a secondary winding, an HID lamp, and a light fixture capacitor coupled in series with the secondary winding and the HID lamp, the method comprising the steps of:

replacing the light fixture capacitor with a first retrofit capacitor;

providing a retrofit apparatus that does not comprise a ballast transformer but comprises:

a pair of terminals;

a second retrofit capacitor; and a switching device coupled in series with the second retrofit capacitor between the terminals;

couplinig respective ones of the terminals to the secondary winding and the HID lamp such that the retrofit apparatus is in series with the secondary winding and the HID lamp and in parallel with the first retrofit capacitor;

wherein the switching device (a) couples the first and second retrofit capacitors in parallel in response to a normal power mode control input, and (b) uncouples the first and second retrofit capacitors from being in parallel in response to a low power mode control input; and wherein the HID lamp provides normal intensity lighting at normal power in response to an AC input to the primary winding and the normal power mode control input to the switching device and provides low intensity lighting at low power in response to an AC input to the primary winding and the low power mode control input to the switching device.

12. The method of claim 11 wherein the retrofit apparatus further comprises an enclosure that encloses the second retrofit capacitors and the switching device but does not enclose the terminals, the second retrofit capacitor, and any ballast transformer.

* * * * *